US011131102B1

(12) United States Patent
Hendifar

(10) Patent No.: US 11,131,102 B1
(45) Date of Patent: Sep. 28, 2021

(54) MODULAR FLOOR COVERING SYSTEM

(71) Applicant: APPARATUS LLC, New York, NY (US)

(72) Inventor: Gabriel Hendifar, New York, NY (US)

(73) Assignee: APPARATUS LLC, New York, NY (US)

( * ) Notice: Subject to any disclaimer, the term of this patent is extended or adjusted under 35 U.S.C. 154(b) by 0 days.

(21) Appl. No.: 17/241,180

(22) Filed: Apr. 27, 2021

Related U.S. Application Data

(60) Provisional application No. 63/142,025, filed on Jan. 27, 2021.

(51) Int. Cl.
*E04F 21/00* (2006.01)
*E04F 15/10* (2006.01)
*E04F 15/02* (2006.01)

(52) U.S. Cl.
CPC .... *E04F 21/0092* (2013.01); *E04F 15/02038* (2013.01); *E04F 15/10* (2013.01); *E04F 2201/0523* (2013.01)

(58) Field of Classification Search
CPC ..... E04F 21/0092; E04F 15/10; E04F 2201/0523
See application file for complete search history.

(56) References Cited

U.S. PATENT DOCUMENTS 3,538,536 A * 11/1970 James ..... A47G 27/0431 16/16
3,711,349 A * 1/1973 Snyder ..... A47G 27/045 156/157
4,152,473 A * 5/1979 Layman ..... B29C 65/5042 156/284
4,769,895 A * 9/1988 Parkins ..... A47G 27/0481 15/215
5,486,392 A * 1/1996 Green ..... A47L 23/26 15/215
6,083,596 A * 7/2000 Pacione ..... A47G 27/045 156/304.3
7,108,902 B2 * 9/2006 Ellingson ..... B32B 3/14 428/54

(Continued)

OTHER PUBLICATIONS

Pei-Ru Keh; Apparatus' new LA showroom channels the spirit of Giorgio de Chirico paintings; WALLPAPER; https://www.wallpaper.com/design/apparatus-los-angeles-showroom; Wallpaper; Design; Nov. 27, 2018.

(Continued)

*Primary Examiner* — Gisele D Ford
(74) *Attorney, Agent, or Firm* — Gottlieb, Rackman & Reisman, P.C.

(57) ABSTRACT

A modular rug system includes a plurality of rug elements spaced apart from and connected to one another via a plurality of elongated fasteners. Each fastener connects two neighboring rug elements to one another. Each fastener has a first elongated component extending under a pair of neighboring rug elements, a second component disposed on a top surface of one of the pair of neighboring rug elements, and a third component disposed on a top surface of the other of the pair of rug elements. The top surfaces of neighboring rug elements are respectively recessed at defined locations in order to receive the second and third components of the fastener therein.

17 Claims, 15 Drawing Sheets

(56) References Cited

U.S. PATENT DOCUMENTS

| | | | | |
|---|---|---|---|---|
| 7,721,502 | B2 * | 5/2010 | Scott | E04F 21/1657 52/506.05 |
| 8,074,411 | B1 * | 12/2011 | Anderson | E04F 13/005 52/222 |
| 8,381,370 | B2 * | 2/2013 | Higashinaka | A47G 27/045 24/444 |
| 8,429,879 | B1 * | 4/2013 | Hoffman | E04F 21/0092 52/747.11 |
| 10,556,387 | B2 * | 2/2020 | Bennett | B32B 5/026 |
| 2003/0192484 | A1 * | 10/2003 | Folkema | E04F 15/10 119/526 |
| 2005/0144875 | A1 * | 7/2005 | Lenhard-Backhaus | E04F 13/0862 52/506.01 |
| 2006/0156666 | A1 * | 7/2006 | Caufield | E04F 15/10 52/483.1 |
| 2011/0061328 | A1 * | 3/2011 | Sandy | A47G 27/0481 52/582.1 |
| 2011/0067340 | A1 * | 3/2011 | Shapiro | E04F 15/10 52/578 |
| 2014/0325936 | A1 * | 11/2014 | PSaila | E04F 21/0092 52/749.11 |

OTHER PUBLICATIONS

Nicole Anderson; 8 Salon Art + Design 2019 Standouts; https://www.architecturaldigest.com/story/8-salon-art-design-2019-standouts; Architectrual Digest; Design 2019 Standouts; Nov. 16, 2019.

* cited by examiner

MODULAR FLOOR COVERING SYSTEM

CROSS-REFERENCE TO RELATED APPLICATION

This non-provisional patent application claims priority under 35 U.S.C. § 119 to U.S. provisional patent application No. 63/142,025, filed on Jan. 27, 2021, the disclosure of which is incorporated by reference herein in its entirety.

TECHNICAL FIELD

The present invention relates to a floor covering system, and more particularly, to a modular floor covering system that utilizes a plurality of fasteners for connecting a plurality of floor covering components to one another.

DISCUSSION OF THE RELATED ART

A modular rug system includes a pair of individual rugs connected to one another by fasteners. The rugs are configured to cover a floor surface area. Fasteners that create a secure connection between the rugs may have a first component extending on the underside of the rugs and a second component disposed over the top surface of each of the rugs. The first and second components of each fastener would extend through the thickness of the rugs and would connect to one another for creating a secure connection between the rugs and the fasteners. However, the second component of each fastener typically protrudes above the top surface of a rug, creating a visual bump on top of each rug and an uneven surface to step on.

Therefore, an improved way to connect rug pieces to one another is needed.

SUMMARY

It is an object of the present invention to provide a modular rug system including two or more spaced rug and/or carpet components (collectively "rugs") that are selectively and securely connected to one another via a plurality of fasteners that do not protrude upwardly over the upper surfaces of the rugs.

Each rug in the modular rug system of the present invention includes a plurality of through openings. Each fastener includes an elongated link extending between a through opening of a first rug and a through opening of a second rug (adjoining the first rug) on an underside of the two rugs, and a pair of nuts, bolts or screws (collectively "screws") disposed over the adjoining rugs and selectively connected to opposite ends of the link—via a through opening in each of the first and second rugs—in order to securely connect the first and second rugs to one another.

Significantly, each rug in the modular rug system present invention has a plurality of recesses at its top surface. Each recess is configured to house one of the screws therein in order to prevent the screw from protruding upwardly over the top surface of each rug. This configuration provides an even walkable surface over the rugs and reduces the likelihood of a user tripping over the modular rug system of the present invention since the screw heads do not protrude upwardly over the rugs.

The recesses and the through holes in the rugs may be formed during the manufacturing process at predetermined locations along one or more edges of each rug. This configuration is advantageous for several reasons. First, the recesses serve as visual guides, indicating to a technician the location of each link under each rug such that the technician can quickly and efficiently connect a screw to each end of each link during the installation process. This can reduce installation time and labor costs associated therewith. Second, the configuration is advantageous as there is no technical need to drill/punch the through holes in the field during the installation process, thereby further reducing installation time and labor costs.

In each rug, the recesses can be manufactured by using a different yarn and/or a different knitting or weaving pattern than that utilized in the remainder of the rug in order to further assist a technician in visually distinguishing the depressions during installation of the modular rug system of the present invention.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
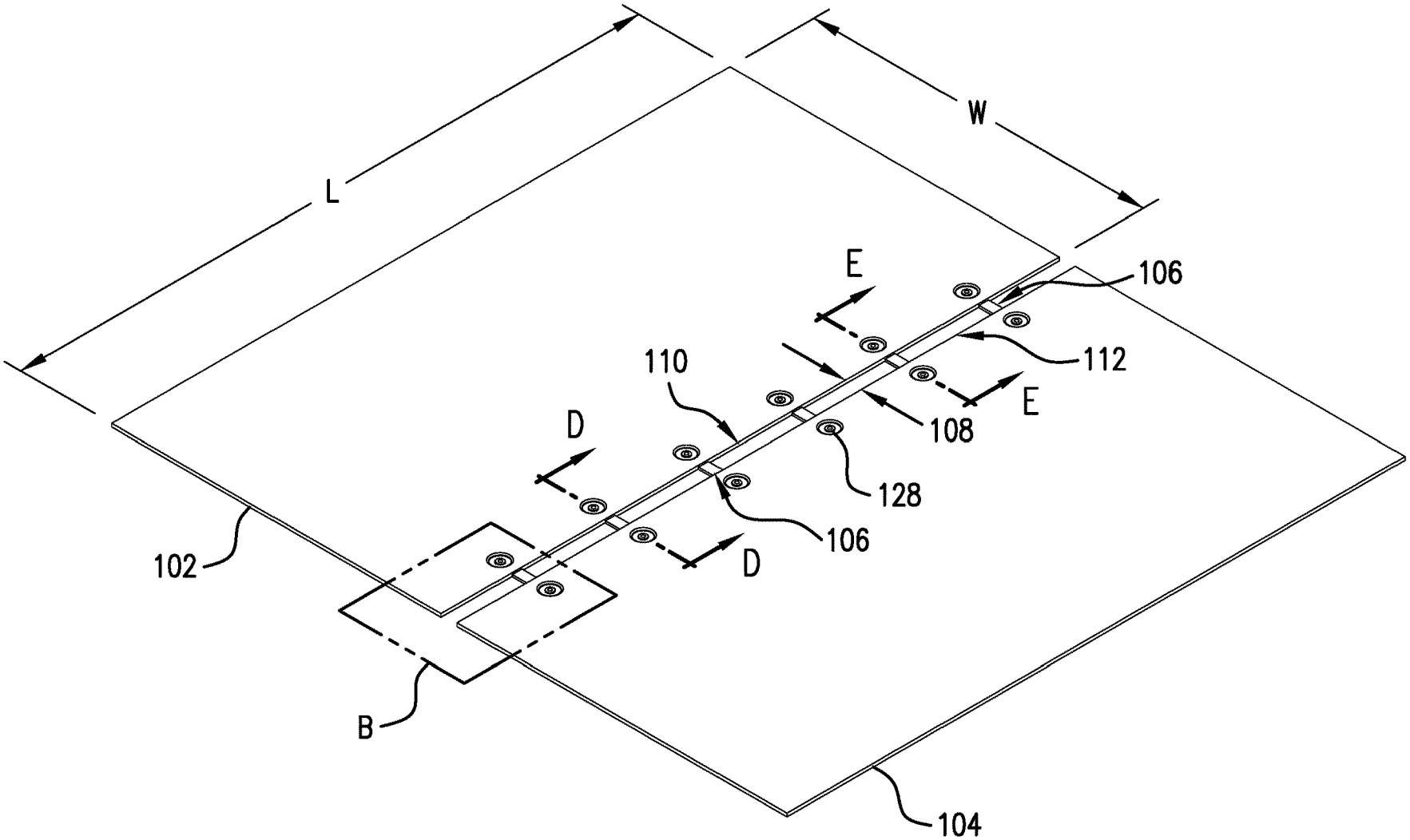
FIG. 1 is a perspective view illustrating a modular floor covering system according to an exemplary embodiment of the present invention.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity. In addition, the dimensions illustrated in the drawings are merely exemplary. The scope of the present invention is not limited thereto.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

FIGS. 1-15 illustrate a modular floor covering system according to an exemplary embodiment of the present invention.

The modular floor covering system of FIGS. 1-15 includes a first floor covering component 102, a second floor covering component 104, and a plurality of connecting members 106 selectively connecting the first and second floor covering components 102 and 104 to one another along a length of neighboring sides of the first and second floor covering components 102 and 104. The first and second floor covering components 102 and 104 may be referred to as floor covers for brevity purposes.

Each one of the first and second floor covers 102 and 104 may be a rug, a carpet, or more broadly, a flexible sheet of fabric material that is suitable for covering and/or protecting a floor area. The first and second floor covers 102 and 104 may be configured to cover a floor surface that receives foot traffic, a floor surface that is not subject to foot traffic, and/or a floor surface that supports furniture in order to protect the underlying floor surface from wear and tear and/or damage that could occur through repeated use.

The first and second floor covers 102 and 104 may be made of the same material and/or construction as one another, or of different materials and/or construction. For example, each one of the first and second floor covers 102 and 104 can be a piece of carpet or a rug that is formed by weaving or knitting flexible fiber material, a sheet of nonwoven material such as felt or the like, or a combination thereof.

The fiber that is woven or knit to form the carpet/rug floors covers 102 and 104 may be a natural or a synthetic material, for example, wool, silk, linen, cotton, polyester, nylon, rayon, polyamide, etc., or a blend thereof. The nonwoven sheet material may include natural fibers, for example, wool, fur (e.g., hair fibers from animals other than sheep and goat), or a blend thereof, synthetic fibers, for example, acrylic fibers, nylon fibers, polyester fibers, etc., or a blend thereof, or a blend of natural and synthetic fibers.

In the embodiment of FIGS. 1-15 (see FIGS. 1-4 in particular), the first and second floor covers 102 and 104 have the same shape and size as one another. However, the present invention is not limited thereto. A modular floor covering system according to the present invention can be formed of two or more floor covers that are connected to one another, and the shape and size of each floor cover can be the same as or different from the shape and size of the other floor cover(s) of the modular floor covering system.

Figure 2:
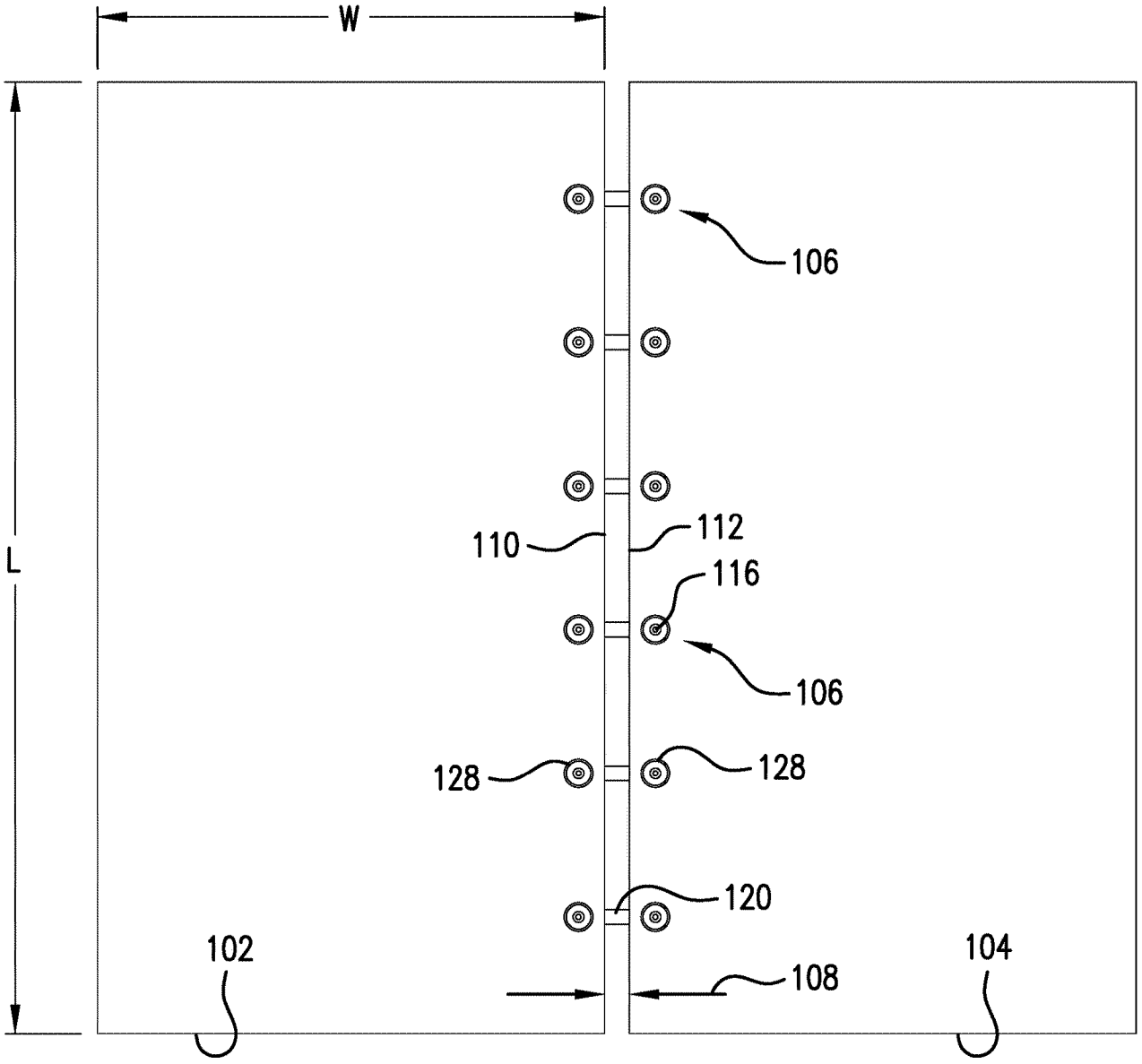
FIG. 2 is a top plan view illustrating the modular floor covering system of FIG. 1.
Figure 3:
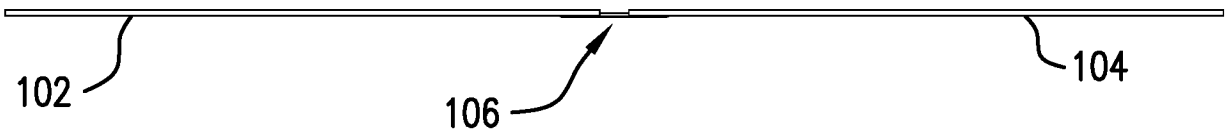
FIG. 3 is a side elevational view illustrating the modular floor covering system of FIG. 1.
Figure 4:
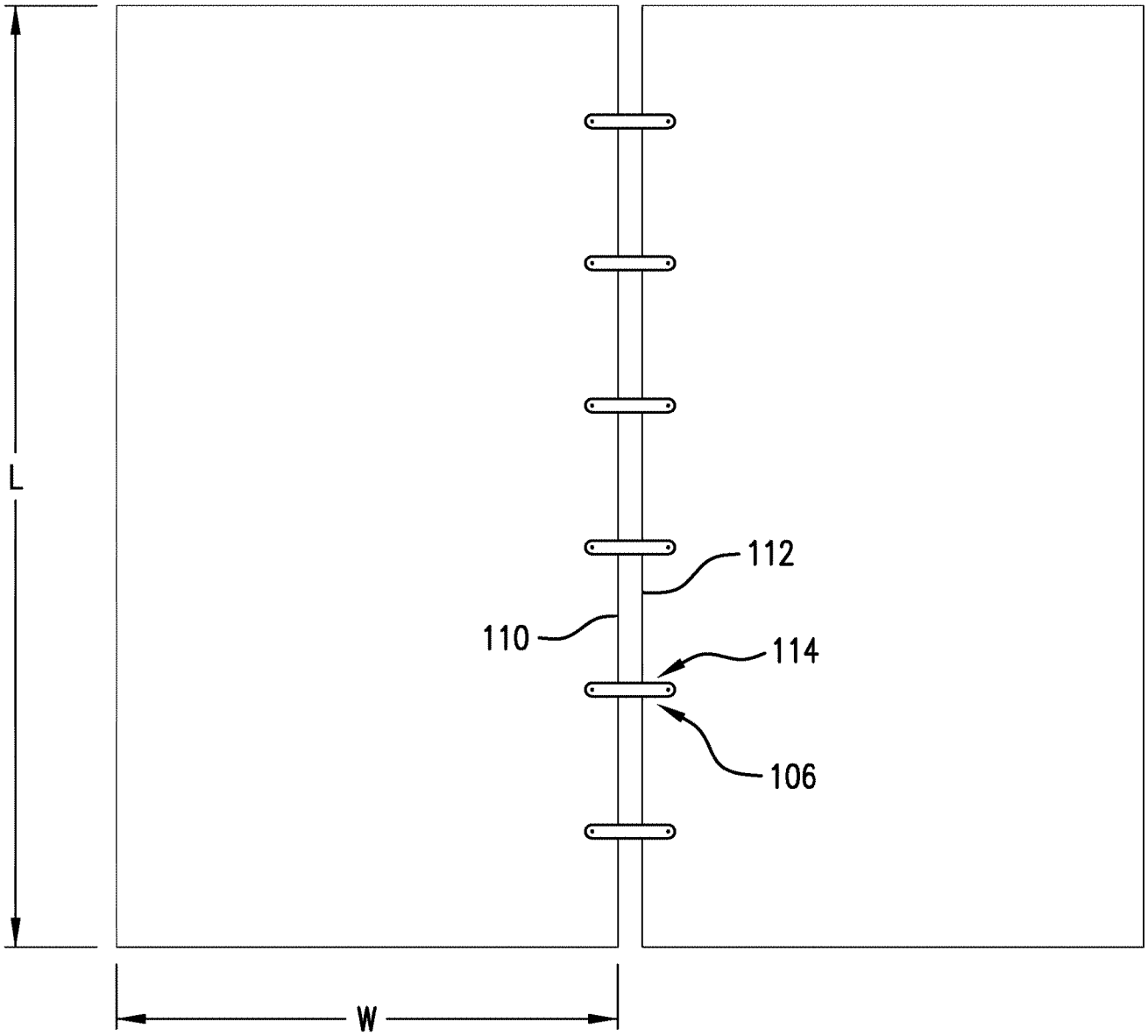
FIG. 4 is a bottom plan view illustrating the modular floor covering system of FIG. 1.

Referring to FIGS. 1, 2 and 4 the first floor cover 102 has a width W and a length L of predetermined dimensions, and a side 110 (or edge 110) facing (or neighboring) the second floor cover 104. As illustrated, the length L is greater than the width W. Referring to FIGS. 1, 2 and 4 again, the second floor cover 104 has a side 112 (or edge 112) facing the side 110 of the first floor cover 102. In other words, the sides 110 and 112 face one another.

In FIGS. 1, 2 and 4 the first and second floor covers 102 and 104 are illustrated as being rectangular, but the present invention is not limited to this shape. Each one of the first and second floor covers 102 and 104 may have, for example, a polygonal shape, a circular shape, an elliptical shape, an oval shape, or an irregular shape.

FIGS. 5-10 illustrate one of the connecting members 106 that is used to selectively connect the first and second floor covers 102 and 104 to one another. In the embodiment of FIGS. 1-15, all of the connecting members 106 are the same as one another. However, this configuration is non-limiting, and a modular floor covering system of the present invention may also employ different kinds of connecting members for connecting the two or more pieces of floor covers to one another.

Each connecting member 106 can be made of a metal, a polymeric material, leather (which would include suede), different kinds of woven fabrics, leather-wrapped or fabric-wrapped substrates (e.g., substrates like "TEXON", offered for sale by Texon Materials, Inc.), wood, materials like sisal and jute, or a combination thereof. The metal may be, for example, brass, aluminum, steel, copper, etc., or of an alloy of metals. The polymeric material may be, for example, polyvinyl chloride (PVC), polycarbonate, or other material exhibiting sufficient structural toughness under load. More specifically, coupling components 118 (described below), of each connecting member 106 are preferably made of a metal, elastomeric material, wood, or combination thereof, while each connecting element 114 (described below) can be made of any one of the materials described above or of a combination thereof.

In order for the connecting members 106 to selectively and securely connect the first and second floor covers to one another, the first floor cover 102 includes a plurality of through openings 122 (see FIGS. 14 and 15) spaced apart from one another and disposed substantially adjacent to the side 110 (along the length of side 110). Each opening 122 extends through the entire thickness of the first floor cover 102 and is configured to receive a portion of a respective connecting member 106 therethrough in order to selectively connect the first floor cover 102 with each connecting member 106.

In addition, the second floor cover 104 also includes a plurality of through openings 122 (see FIGS. 12 and 15) spaced apart from one another and disposed substantially adjacent to the side 112 (along the length of side 112). Each opening 122 in the second floor cover 104 extends through the entire thickness of the second floor cover 104, and is configured to receive a portion of a respective connecting member 106 therethrough in order to selectively connect the second floor cover 104 with each connecting member 106. As illustrated in FIGS. 1, 2, 12, 13 and 15, each opening 122 may extend from a center of its respective recess 128 in both the first and second floor covers 102 and 104.

As illustrated in FIGS. 1, 2 and 4, matching pairs of the openings 122 (and recesses 128) in the first and second floor coverings 102 and 104 are arranged at equal intervals from one another along the length of the sides 110 and 112 such that the intervals between the connecting members 106 may be substantially equal with one another. However, the present invention is not limited thereto, and the intervals between the connecting members 106 may be varied in dimension as desired by varying the locations of the openings 122 and recesses 128.

Figure 5:
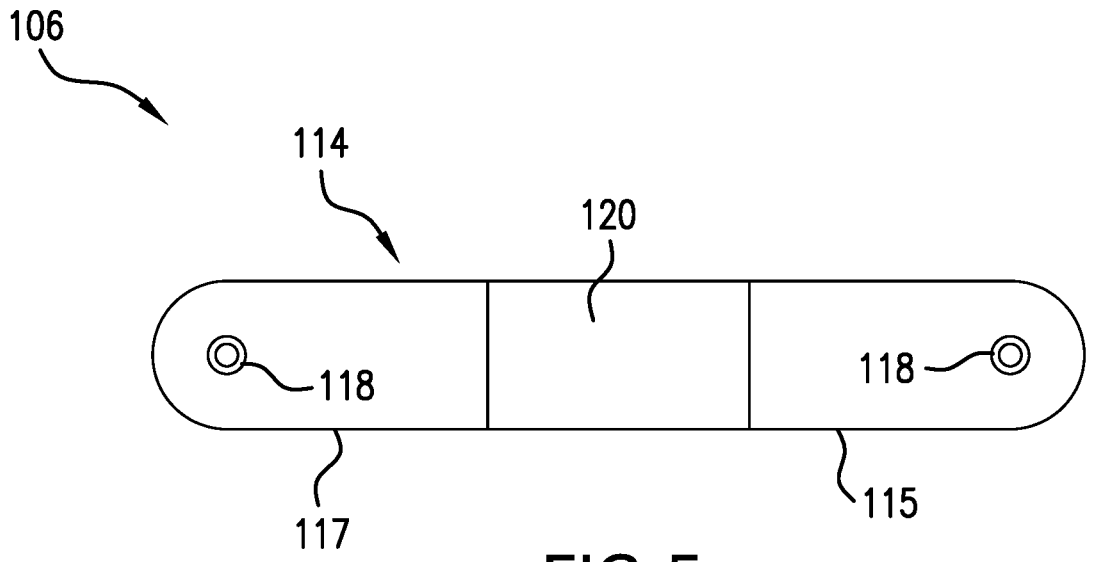
FIG. 5 is a top plan view illustrating a connecting element that is included in the modular floor covering system of FIG. 1, according to an exemplary embodiment of the present invention.
Figure 6:
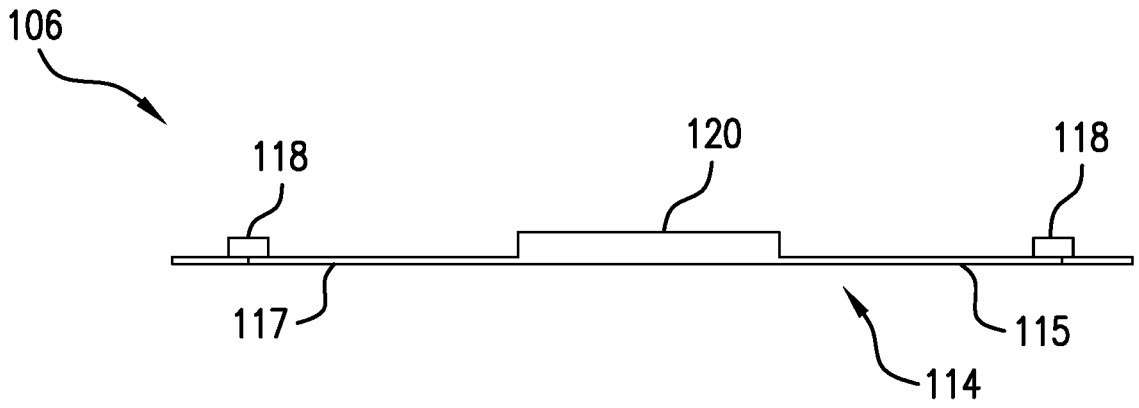
FIG. 6 is a side elevational view illustrating the connecting element of FIG. 5.
Figure 7:
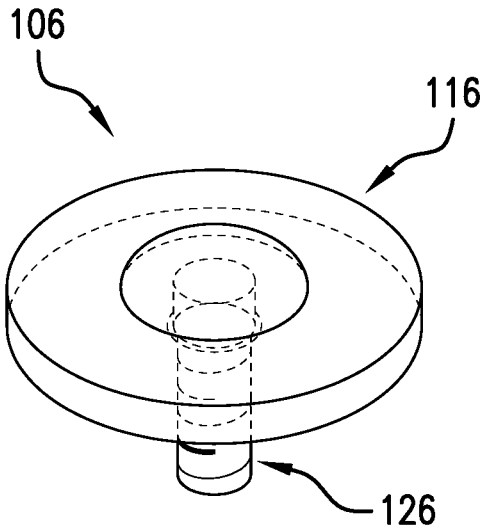
FIG. 7 is a perspective view illustrating a fastener that is configured to be selectively connected to the connecting element of FIG. 5, according to an exemplary embodiment of the present invention.
Figure 8:
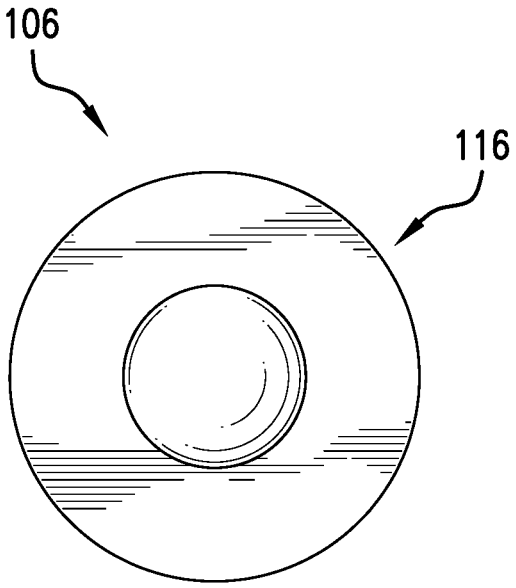
FIG. 8 is a top plan view illustrating the fastener of FIG. 7.
Figure 9:
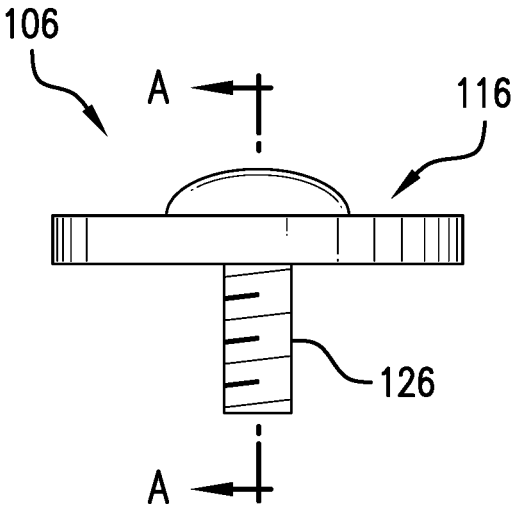
FIG. 9 is a side elevational view illustrating the fastener of FIG. 7.
Figure 10:
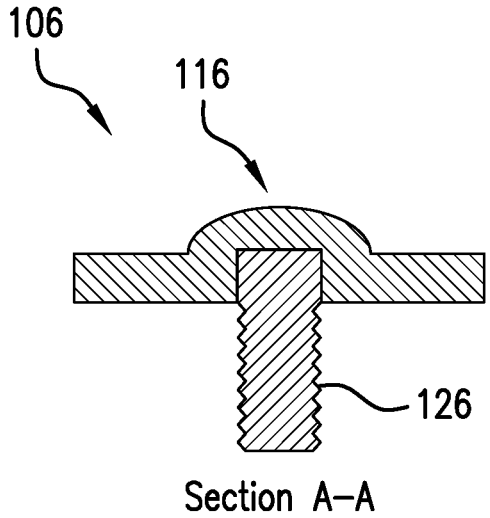
FIG. 10 is a cross-sectional view taken along line A-A of FIG. 9.
Figure 15:
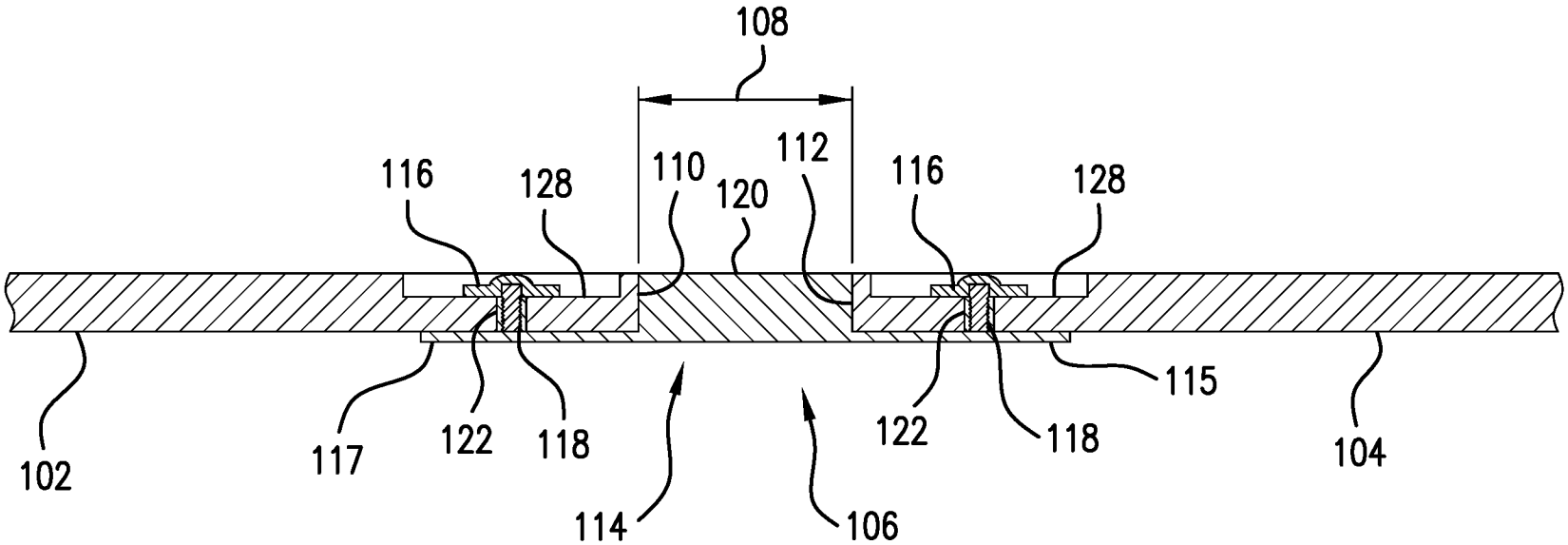
FIG. 15 is a cross-sectional view taken along line E-E of FIG. 1.
Figure 16:
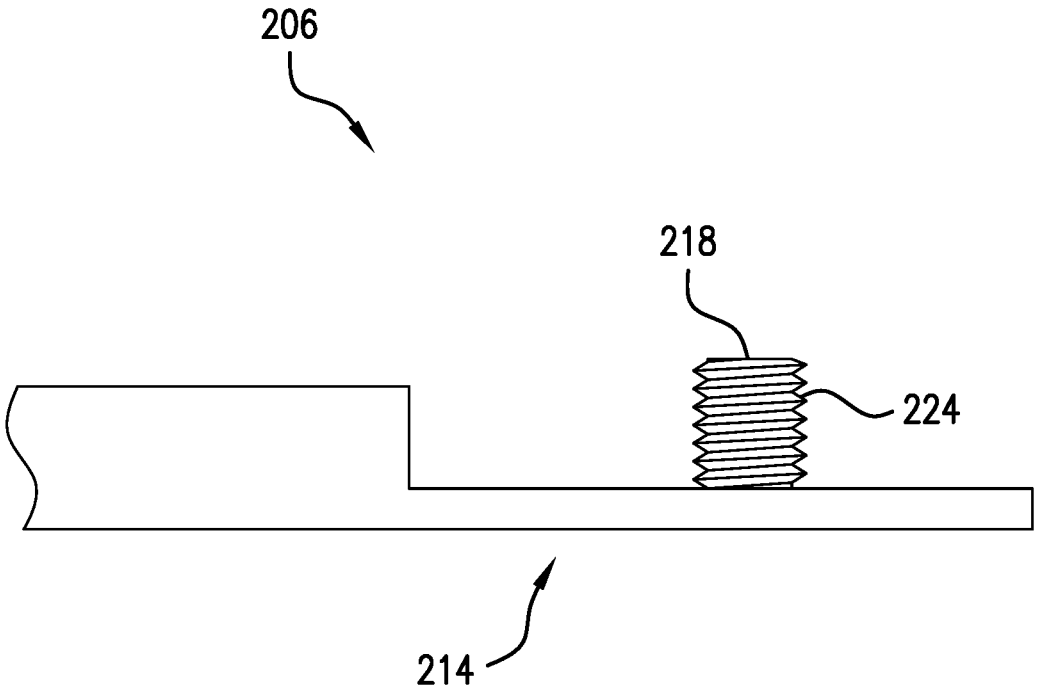
FIG. 16 is a side elevational view illustrating a portion of a connecting element according to an exemplary embodiment of the present invention.
Figure 17:
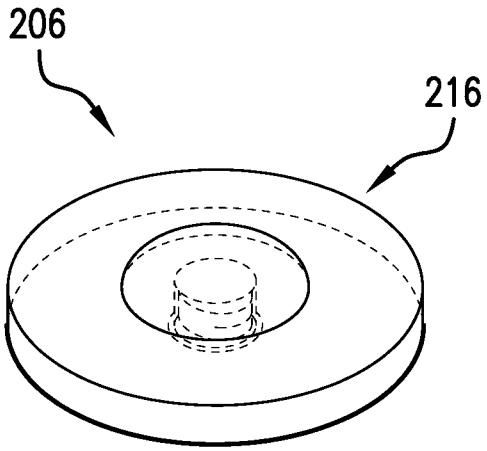
FIG. 17 is a perspective view illustrating a fastener that is configured to be selectively connected to the connecting element of FIG. 16, according to an exemplary embodiment of the present invention.
Figure 18:
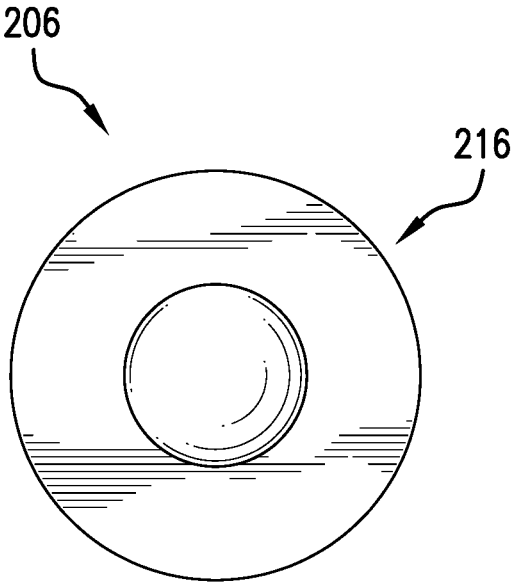
FIG. 18 is a top view illustrating the fastener of FIG. 17.
Figure 19:
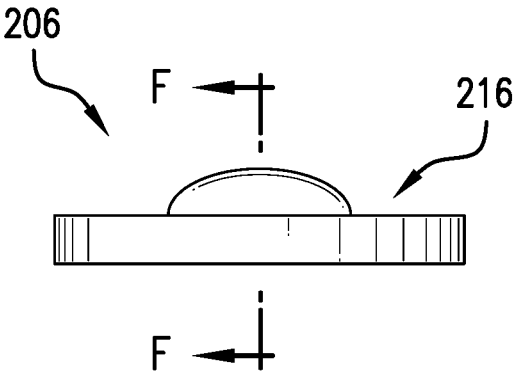
FIG. 19 is a side elevational view illustrating the fastener of FIG. 17.
Figure 20:
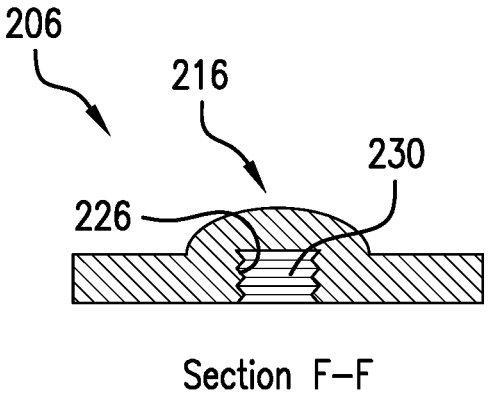
FIG. 20 is a cross-sectional view taken along line F-F of FIG. 19.

Referring to FIGS. 5-12, each connecting member 106 includes a connecting element 114 (see FIGS. 5 and 6) and a pair of fasteners 116 (see FIGS. 7-10 illustrating one of the fasteners 116) that are configured to be selectively attached to the connecting element 114. Referring to FIGS. 5, 6 and 15, each connecting element 114 of each connecting member 106 includes a centrally located body 120, a pair of arms 115 and 117 extending from the body 120 at opposite directions, a first coupling component 118 protruding upwardly from arm 115 (see FIG. 6), and a second coupling component 118 protruding upwardly from arm 117 (see FIG. 6). In other words, the two coupling component 118 are spaced apart from one another along a length of the connecting element 114, and are located near opposite ends of the connecting element 114.

With reference to FIG. 15, in each connecting member 106, one of the coupling components 118 is configured to be inserted upwardly from a bottom surface (or rear face) of the first floor cover 102 into one of the openings 122 of the first floor cover 102, and the other coupling component 118 is configured to be inserted upwardly from a bottom surface (or rear face) of the second floor cover 104 into a matching opening 122 of the second floor cover 104.

Then, for each connecting member 106, a first fastener 116 is selectively connected to one of the coupling components 118—from a top surface (or front face) of the first floor cover 102—via the opening 122 in the first floor cover 102, and a second fastener 116 is selectively connected to the other coupling component 118—from a top surface (or front face) of the second floor cover 104—via the opening 122 in the second floor cover 104. See FIG. 15 illustrating a pair of fasteners 116 being selectively connected to the coupling components 118 of a connecting member 106 from a top surface of the modular floor covering system.

The first and second fasteners 116 may be made of a metal, a polymeric material, and/or wood, as described elsewhere in this specification.

Figure 12:
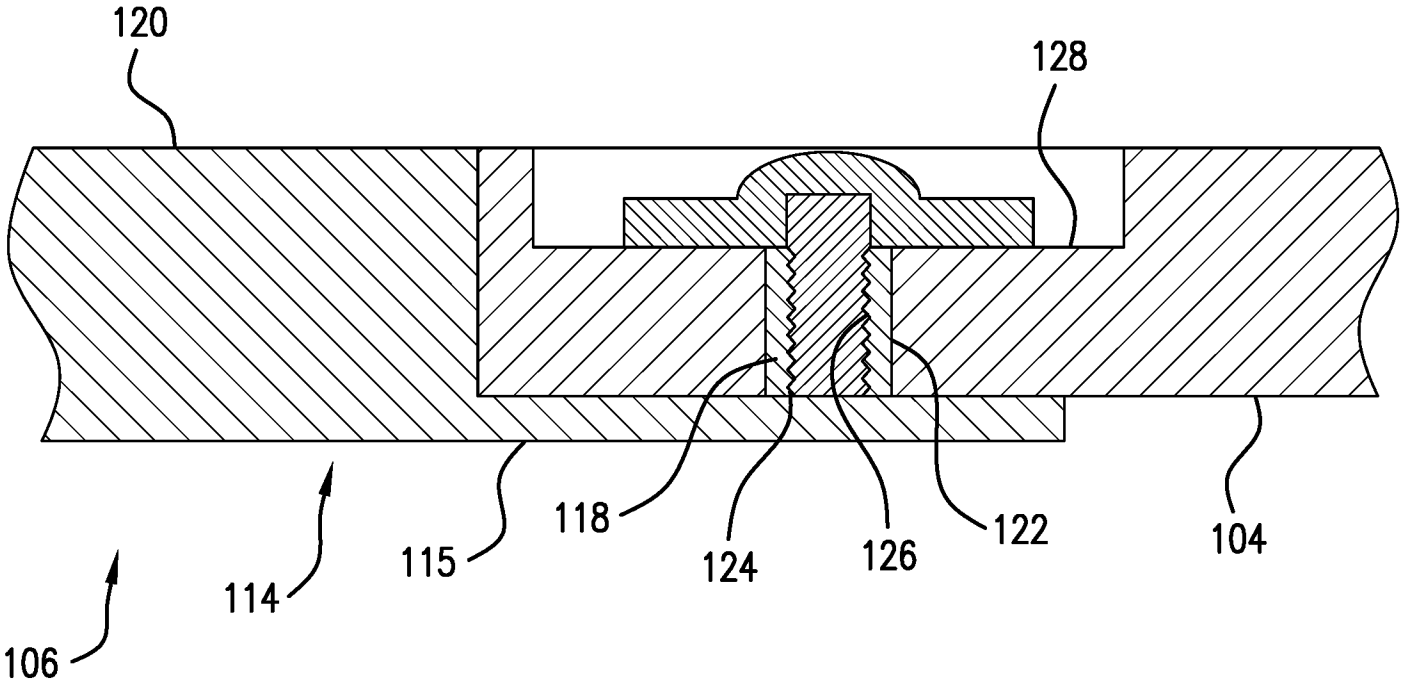
FIG. 12 is a cross-sectional view taken along line C-C of FIG. 11.

As illustrated in FIG. 12, each coupling component 118 may include internal threads 124. Referring to FIGS. 7-10 and 12, each fastener 116 may include a protrusion with external threads 126. In other words, the fastener 116 of FIGS. 7-10 and 12 is a male fastener. The threads 124 and 126 match one another such that two fasteners 116 can be selectively coupled to a connecting element 114 by screwing each fastener 116 into a corresponding coupling component 118 of each connecting element 114.

However, the present invention is not limited to this connection scheme between a connecting element 114 and the fasteners 116 of a connecting member 106. For example, FIGS. 16 and 17-20 illustrate a connecting member 206 featuring threads 224 on the outside of a coupling component 218 (see FIG. 16) of a connecting element 214, and a fastener 216 having internal threads 226 formed inside of a cavity 230 of the fastener 216 (see FIG. 20). In other words, the fastener 216 is a female fastener. When the coupling component 218 and the fastener 216 are selectively connected to one another, the coupling component 218 is able to be accommodated inside of the cavity 230 of the fastener 216.

Other fastening mechanisms may be used in addition to, or instead of, those described above. For example, a coupling component and a respective fastener can be configured to snap onto one another in order to be selectively coupled to one another, or could have an interference fit/force fit configuration. For example, in the interference fit configuration, the coupling component and the respective fastener can be similar to their respective counterparts shown in FIGS. 16 and 17-20, except that, the coupling component and the respective fastener would not have threads and would therefore selectively mate via an interference fit.

As illustrated in FIG. 15, the protruding body 120 of each connecting element 114 extends in the gap 108 between the first and second floor covers 102 and 104.

The first and second floor covers 102 and 104 are spaced apart from one another by a gap 108, as more clearly illustrated in FIGS. 1, 2, 13 and 15. The gap 108 is predetermined by the structural configuration of the connecting members 106 and the location of through openings 122 in the first and second floor covers 102 and 104 (see FIG. 15). The gap 108 is preferably constant throughout the length of facing sides 110 and 112 of the first and second floor covers 102 and 104.

As illustrated in FIG. 15, the protruding body 120 of each connecting element 114 preferably extends the entire width of the gap 108. Alternatively, the protruding body 120 of each connecting element 114 extends less than the entire width of the gap 108. In addition, the modular floor covering system of the invention can include a mixture of connecting elements having different protruding bodies, some that extend the entire width of the gap and others that extend less than the entire width of the gap between two pieces of rug or carpet elements.

The top of the protruding body 120 of at least one connecting member 106 can be configured to match the top surface of the first and second floor covers 102 and 104 in order to act as a bridge between the first and second floor covers 102 and 104. Alternatively, the vertical height of the protruding body 120 of at least one of the connecting members 106 may be set to be below the top elevation of the first and second floor covers 102 and 104.

Figure 11:
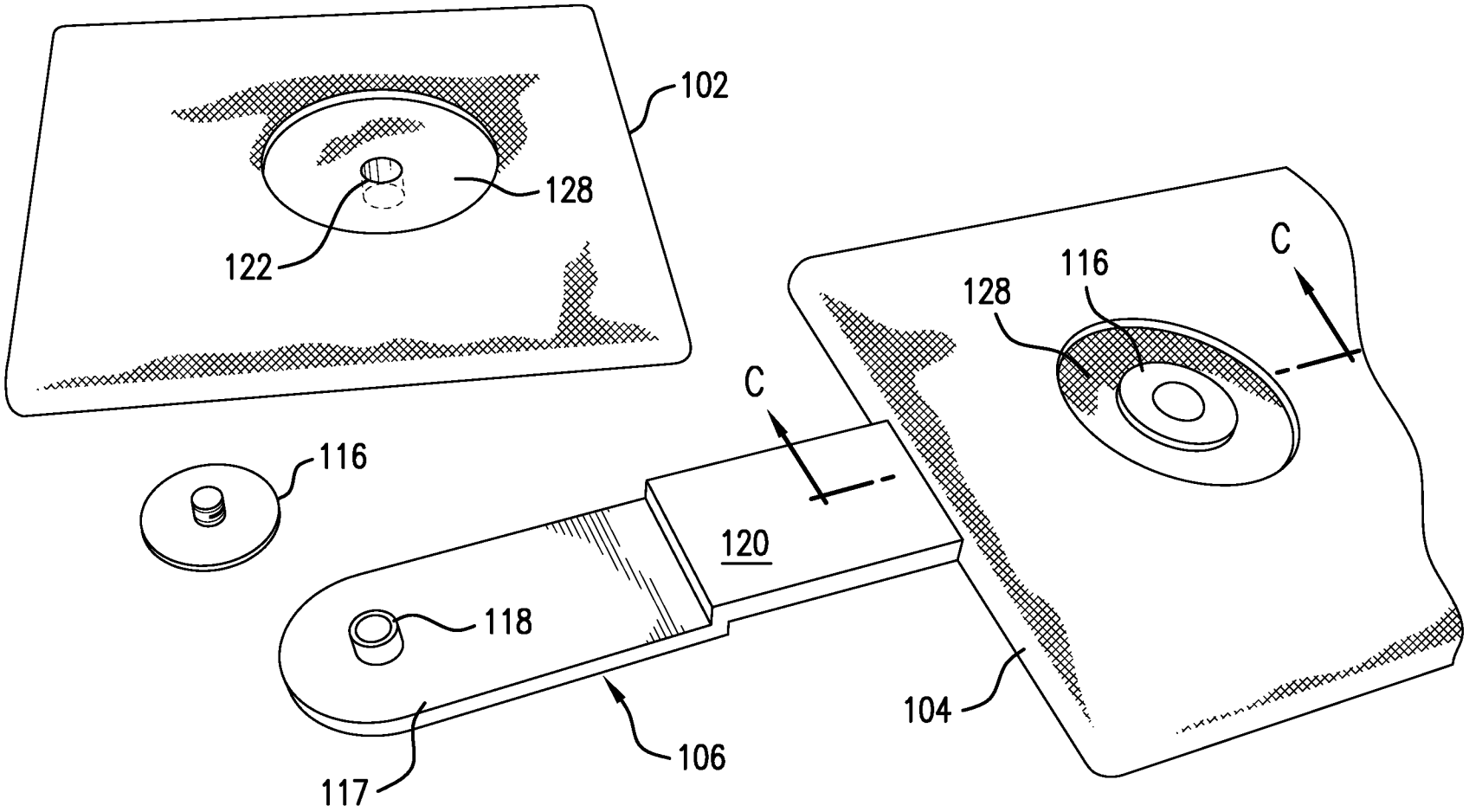
FIG. 11 is a perspective view illustrating a cut-out region B of FIG. 1.
Figure 13:
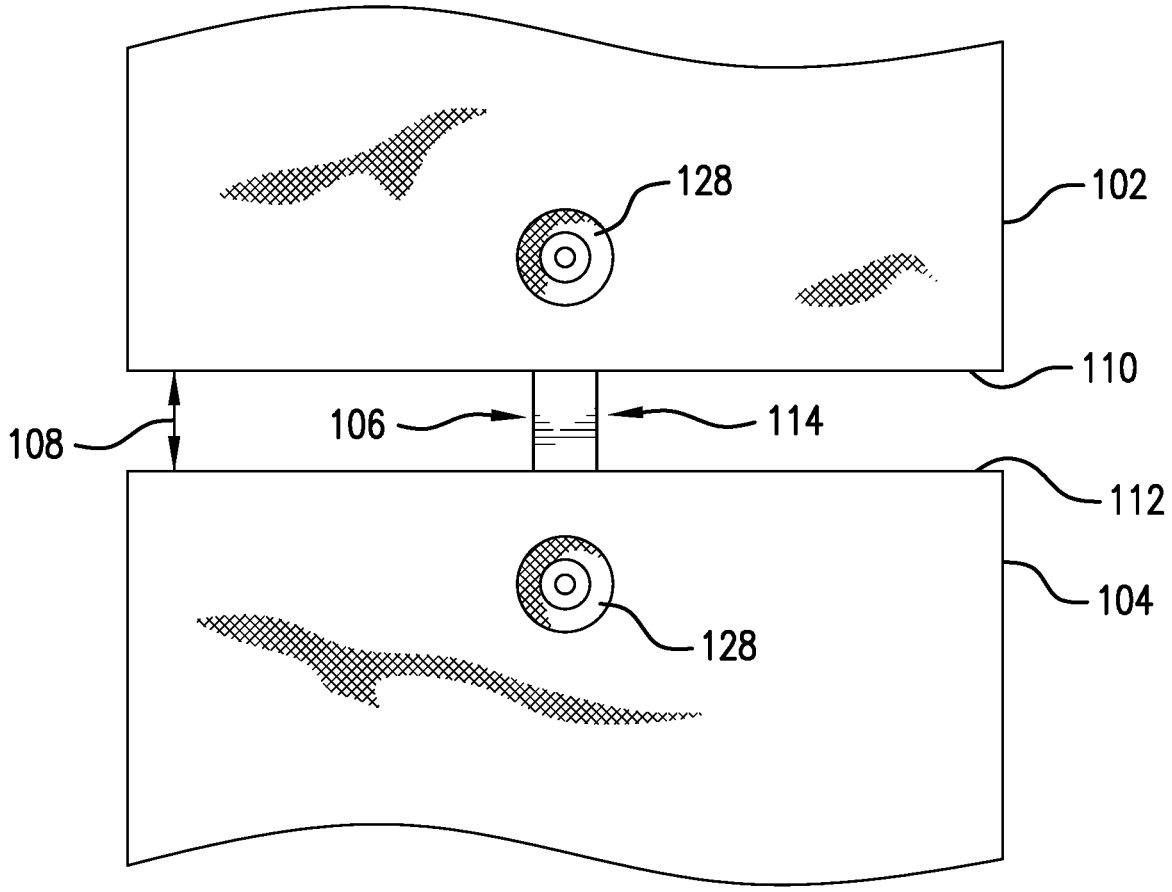
FIG. 13 is a top plan view illustrating the cut-out region B of FIG. 1.
Figure 14:
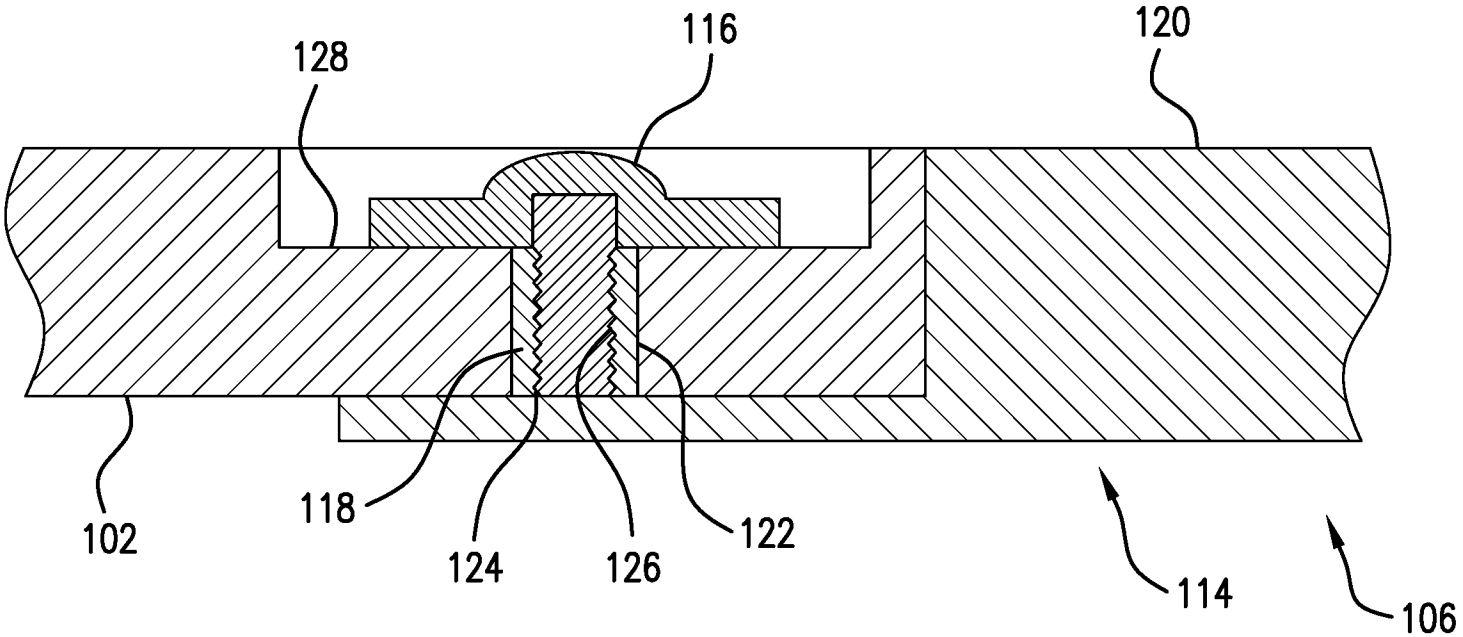
FIG. 14 is a cross-sectional view taken along line D-D of FIG. 1.

Referring to FIGS. 1, 2 and 13, and more particularly to FIGS. 11, 12 and 15, the top side of each one of the first and second floor covers 102 and 104 includes an annular recess or depression 128 disposed around each opening 122. Each recess 128 may be formed, for example, by weaving or knitting the first and second floor covers 102 and 104 with a shorter pile and/or a different texture than the remainder of the first and second floor covers 102 and 104. A pile may be the raised surface or nap of a fabric, which consists of upright loops or strands of yarn.

In other words, each of the first and second floor covers 102 and 104 can be made of a fabric material having a shorter pile construction and/or a different texture at the recesses 128 than at other portions (or remainder) of the first and second floor covers 102 and 104. Each recess 128 in the first floor cover 102 is an integral part (or continuous part) of the first floor cover 102, and each recess 128 in the second floor cover 104 is an integral part of the second floor cover 104.

The opening 122 in each recess 128 may be pre-formed during the weaving and/or knitting process that is used to create the first and second floor covers 102 and 104. Alternatively, the opening 122 in each recess 128 in the first and second floor covers 102 and 104 may be formed by a punching and/or drilling process as known to those skilled in the art after the first and second floor covers 102 and 104 are manufactured.

As illustrated in FIGS. 1-2, 13 and 15, the recesses 128 in the first floor cover 102 are arranged adjacent to the side 110 of the first floor cover 102, and the recesses 128 in the second floor cover 104 are arranged adjacent to the side 112 of the second floor cover 104.

It is preferred that the fasteners 116, 216 (see FIG. 20), etc., do not extend above the height of a modular floor covering system (e.g., above a top surface of the first and second floor covers 102 and 104). This way, the possibility of a user tripping over the fasteners 116 is reduced or eliminated. For this purpose, as illustrated in FIG. 15, each recess 128 houses at least a portion of a respective fastener 116, 216, etc., therein (or preferably the entire fastener 116, 216, etc., therein). In addition, when the upper surfaces of the first and second floor covers 102 and 104 are substantially flush with top surfaces of the fasteners 116, this configuration provides an even surface to walk on over the modular rug system.

As illustrated in FIGS. 12 and 15, since the connecting element 114 of each connecting member 106 extends along the bottom surfaces of (or underneath) the first and second floor covers 102 and 104, and since the fasteners 116 are fastened to each connecting element 114 from the recesses 128 at the top sides of the first and second floor covers 102 and 104, the fasteners 116 engage with the recesses 128 (or grab the recesses 128) in order to selectively connect the first and second floor covers 102 and 104 to each connecting member 106.

The recesses 128 in the first and second floor covers 102 and 104 can also aid in the installation of the modular floor covering system, serving as a visual guide by indicating to an installing technician where the openings 122 are located such that the technician can quickly and easily connect the fasteners 116 to the coupling portions 118 in the openings 122.

Figure 21:
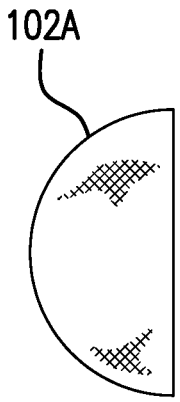
FIG. 21 is a top plan view illustrating a shape of a rug/carpet that can be used in forming a modular floor covering system.
Figure 22:
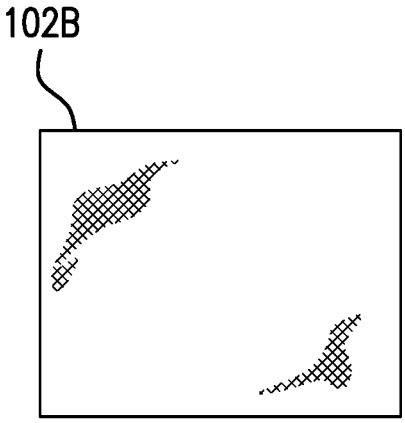
FIG. 22 is a top plan view illustrating another shape of a rug/carpet that can be used in forming a modular floor covering system.
Figure 23:
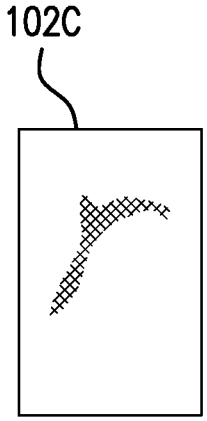
FIG. 23 is a top plan view illustrating yet another shape of a rug/carpet that can be used in forming a modular floor covering system.
Figure 24:
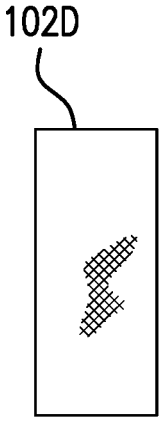
FIG. 24 is a top plan view illustrating still a further shape of a rug/carpet that can be used in forming a modular floor covering system.

FIGS. 21-24 illustrate examples of floor covers having various shapes. For example, FIG. 21 illustrates a half disk-shaped rug 102A. FIGS. 22, 23 and 24 respectively illustrate rectangular-shaped rugs 120B, 102C and 102D, each having different sizes and/or proportions from one another. The floor covers 102A-102D illustrated in FIGS. 21-24 can be used in combination with one another or with floor covers described elsewhere in this specification in order to form a modular floor covering system that has a desired shape and/or size.

The recesses 128 are illustrated as being round in the drawings, but the present invention is not limited to this configuration. The recesses 128 can also have other shapes, for example, an oval shape, an elliptical shape, a polygonal shape, or an irregular shape including flat and/or curved sides.

As stated above, the present invention is directed to a modular floor covering system that includes a plurality of floor covers selectively connected to one another to form a composite floor-covering configuration. In other words, two or more floor covers can be selectively connected to one another to form a modular floor covering system. While the embodiments described above illustrate a modular floor covering systems with two floor covers, it is important to convey that there is no limit on the number of floor covers that can be connected to one another in order to form a modular floor covering system of the present invention. The number of floor covers that are connected to one another depends on the shape and size of the floor area that needs to be covered, among many other considerations described below, such as spacing concerns (e.g., whether the individual pieces of carpet/rug material fit into a transporting vehicle, narrow hallways, small elevators, etc.).

Figure 25:
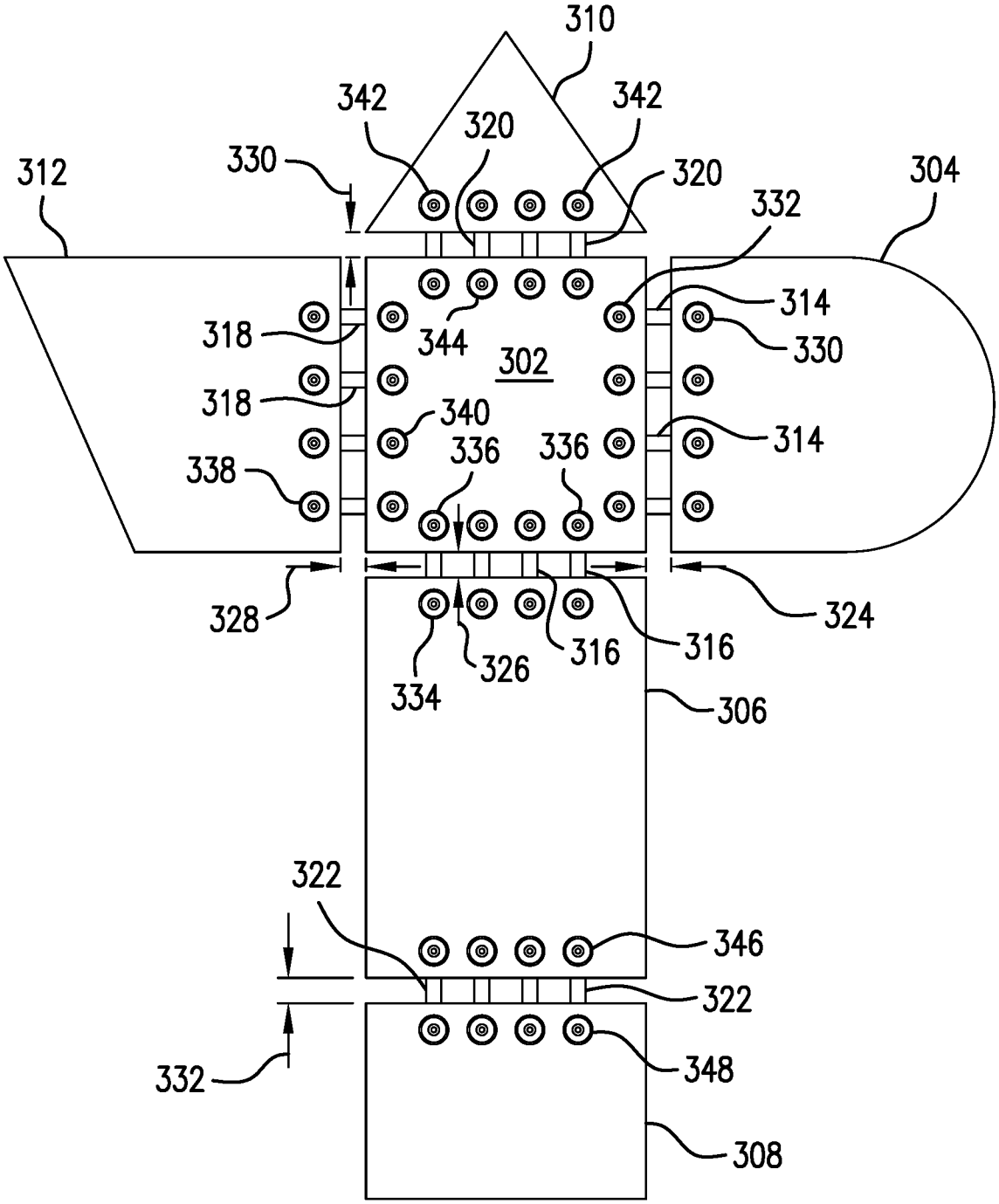
FIG. 25 is a top plan view illustrating a modular floor covering system according to an exemplary embodiment of the present invention.

Merely as an example, the embodiment of FIG. 25 illustrates a modular floor covering system that includes six floor covers.

Referring to FIG. 25, a modular floor covering system includes a plurality of floor covers 302, 304, 306, 308, 310 and 312, and a plurality of connecting members 314, a plurality of connecting members 316, a plurality of connecting members 318, a plurality of connecting members 320, and a plurality of connecting members 322 selectively connecting the floor covers 302-312 to one another.

Each of the connecting members 314, 316, 318, 320 and 322 may be the same as or similar to a connecting member 106, or the same as other connecting members described above.

Referring to FIG. 25, the floor cover 304 may include a plurality of depressions 330 arranged along an edge adjoining the floor cover 302. The floor cover 302 may include a plurality of depressions 332 along an edge adjoining the floor cover 304. The depressions 330 and 332 may be the same as or similar to the depressions 128 described above.

Referring to FIG. 25, the floor cover 306 may include a plurality of depressions 334 arranged along an edge adjoining the floor cover 302. The floor cover 302 may include a plurality of depressions 336 along an edge adjoining the floor cover 306. The depressions 334 and 336 may be the same as or similar to the depressions 128 described above.

Referring to FIG. 25, the floor cover 308 may include a plurality of depressions 348 arranged along an edge adjoining the floor cover 306. The floor cover 306 may include a plurality of depressions 346 along an edge adjoining the floor cover 308. The depressions 346 and 348 may be the same as or similar to the depressions 128 described above.

Referring to FIG. 25, the floor cover 310 may include a plurality of depressions 342 arranged along an edge adjoining the floor cover 302. The floor cover 302 may include a plurality of depressions 344 along an edge adjoining the floor cover 310. The depressions 342 and 344 may be the same as or similar to the depressions 128 described above.

Referring to FIG. 25, the floor cover 312 may include a plurality of depressions 338 arranged along an edge adjoining the floor cover 302. The floor cover 302 may include a plurality of depressions 340 along an edge adjoining the floor cover 312. The depressions 338 and 340 may be the same as or similar to the depressions 128 described above.

As illustrated in FIG. 25, all the sides of the floor cover 302 include connecting members 314-320 in order to selectively connect the floor covers 304, 306 310 and 312 all around the floor cover 302. Depending on the desired configuration of a modular floor covering system, one side, more than one side, or all of the sides of a floor cover can be selectively connected to neighboring floor cover(s) in order to form the modular floor covering system of the present invention.

Referring to FIG. 25, a plurality of gaps 324-332 are formed between the floor covers 302-312. Each one of the gaps 324-332 is preferably constant in width throughout a length of the edges of its respective floor covers. The gaps 324-332 may be the same size as one another, or may be of different sizes. In an embodiment, a modular floor covering system can also have a combination of gaps that are equal to one another (e.g., equal widths) and gaps that are different from one another (e.g., different widths).

The modular floor covering system according to the present invention can be advantageously configured to cover a variety of surface areas having different shapes and/or sizes, for example, compound shapes composed of two or more elemental (or geometric) shapes, and/or irregular shapes. In other words, the individual pieces of carpet, rug and/or non-woven flexible material sheets that form a particular overall shape or configuration may have, for example, a polygonal, circular, elliptical, oval, or irregular shape.

Since the upper surface of each rug of a modular floor covering system of the present invention can be depressed (or recessed) at specific locations in order to fit the fasteners therein (e.g., fasteners 116, 216, etc.), the fasteners can be prevented from protruding upwardly over the top surface of each rug. This configuration can reduce the likelihood of causing a user to trip the since the fasteners do not protrude upwardly over the upper surface of the rugs.

The depressions (or recesses) can also visually aid a technician in locating the through openings in the rugs of the modular rug system of the present invention such that the technician can quickly and efficiently install the connecting members 106, 206, or the like to the rugs.

In order to expedite the installation process of a modular rug system of the present invention, and for aesthetic purposes, the recesses/depressions on the rugs, as described above, can be manufactured by using a different yarn, a different knitting or weaving pattern, or a combination thereof, than the rest of the rug in order to further assist a technician in visually distinguishing the depressions during installation of the modular rug system. However, the present invention is not limited to this configuration, and the recesses/depressions can also manufactured by using the same yarn and/or the same knitting or weaving pattern as the rest of the rug.

The configuration of a modular floor covering system of the present invention is advantageous not only for enabling protective floor coverage of various shapes, but also for enabling a piece-wise installation of the covering system where the transportation and installation of a large one-piece floor covering system would be impractical or cost prohibitive.

For example, the process of manufacturing one large piece of carpet and then cutting that piece into a compound or irregular shape for covering only a desired floor area may be impractical and/or cost prohibitive.

In addition, it may be impractical or even impossible to transport one large piece of carpet or rug from a delivery vehicle into a room other destination when the path leading to that destination includes spatial restrictions such as narrow corridors with bends and a low ceiling, small elevators with a low ceiling, narrow doors, and so on.

The present invention solves such issues by modularizing a floor covering system into individual components that are easy to manufacture, transport, and install on a piece-by-piece basis.

In addition, the use of the connecting members of the present invention not only ensures that the individual floor covering components remain attached to one another after installation, such use also creates a visual gap between the individual floor covering components that improves the aesthetics of the finished product.

While the present invention has been particularly shown and described with reference to exemplary embodiments thereof, it will be apparent to those of ordinary skill in the art that various changes in form and detail may be made therein without departing from the spirit and scope of the present invention as defined by the following claims.

What is claimed is:

1. A modular floor covering system comprising:

a first floor cover having a top surface and a bottom surface, said surfaces defining a first edge of said first floor cover, said first floor cover further including a first through opening formed in the first floor cover and located adjacent to the first edge of said first floor cover, and a recess surrounding at least a portion of the first through opening along said top surface of the first floor cover, the surrounding recess and a portion of the first through opening together defining an upper space in said first floor cover;

a second floor cover spaced from the first floor cover, the second floor cover having a top surface and a bottom surface, said surfaces defining a first edge of said second floor cover, said second floor cover further including a first through opening formed in the second floor cover and located adjacent to the first edge of said second floor cover, and a recess surrounding at least a portion of the first through opening of the second floor cover along the top surface thereof, the surrounding recess of the second floor cover and a portion of the first through opening of the second floor cover together defining an upper space in the second floor cover; and a first connecting member selectively connecting the first and second floor covers to one another, the first connecting member including:

a connecting element extending along the bottom surfaces of the first and second floor covers and having a first end disposed within the first through opening of the first floor cover and a second end disposed within the first through opening of the second floor cover;

a first fastener located within the upper space of the first floor cover, said first fastener being selectively attached to the first end of said connecting element such that the first fastener engages at least part of the recess that surrounds the first through opening of the first floor cover, wherein the first fastener extends entirely within the upper space of the first floor cover such that it does not protrude upwardly above the top surface of the first floor cover; and a second fastener located within the upper space of the second floor cover and selectively attached to the second end of said connecting element such that the second fastener engages at least part of the recess that surrounds the first through opening of the second floor cover, wherein the second fastener extends entirely within the upper space of the second floor cover such that it does nor protrude upwardly above the top surface of the second floor cover, wherein the first floor cover is formed of fabric material having a pile construction along the recess thereof that is different than along the remainder of the first floor cover, and wherein the recess of the first floor cover has a first fabric pile and the remainder of the first floor cover has a second fabric pile, wherein the first fabric pile is shorter in height than the second fabric pile.

2. The modular floor covering system of claim 1, wherein the fabric material along the recess of the first floor cover has a different texture than the fabric material along the remainder of the first floor cover.

3. The modular floor covering system of claim 1, wherein the second floor cover is formed of fabric material having a pile construction along the recess thereof that is different than along the remainder of the second floor cover.

4. The modular floor covering system of claim 3, wherein the recess of the second floor cover has a first fabric pile and the remainder of the second floor cover has a second fabric pile, wherein the first fabric pile of the second floor cover is shorter in height than the second fabric pile of the second floor cover.

5. The modular floor covering system of claim 3, wherein the fabric material along the recess of the second floor cover has a different texture than the fabric material along the remainder of the second floor cover.

6. The modular floor covering system of claim 1, further comprising a second connecting member selectively connecting the first and second floor covers to one another, wherein the first floor cover further includes a second through opening formed in the first floor cover and located adjacent to the first edge of said first floor cover, and a second recess surrounding at least a portion of the second through opening along the top surface of the first floor cover, the surrounding second recess and a portion of the second through opening together defining a second upper space in said first floor cover, wherein the second upper space of the first floor cover is spaced apart from the upper space of the first floor cover;

wherein the second floor cover further includes a second through opening formed in the second floor cover and located adjacent to the first edge of the second floor cover, and a second recess surrounding at least a portion of the second through opening of the second floor cover along the top surface thereof, the surrounding second recess of the second floor cover and a portion of the second through opening of the second floor cover together defining a second upper space in the second floor cover, wherein the second upper space of the second floor cover is spaced apart from the upper space of the second floor cover;

wherein the second connecting member includes:

a connecting element extending along the bottom surfaces of the first and second floor covers and having a first end disposed within the second through opening of the first floor cover and a second end disposed within the second through opening of the second floor cover;

a first fastener located within the second upper space of the first floor cover, said first fastener of the second connecting member being selectively attached to the first end of the connecting element of the second connecting member such that the first fastener of the second connecting member engages at least part of the second recess that surrounds the second through opening of the first floor cover, wherein the first fastener of the second connecting member extends entirely within the second upper space of the first floor cover such that the first fastener of the second connecting member does not protrude upwardly above the top surface of the first floor cover; and a second fastener located within the second upper space of the second floor cover and selectively attached to the second end of said connecting element of the second connecting member such that the second fastener of the second connecting member engages at least part of the second recess that surrounds the second through opening of the second floor cover, wherein the second fastener of the second connecting member extends entirely within the second upper space of the second floor cover such that the second fastener of the second connecting member does not protrude upwardly above the top surface of the second floor cover.

7. The modular floor covering system of claim 6, wherein the first edge of the first floor cover and the first edge of the second floor cover define a gap that separates the first edge of the first floor cover and the first edge of the second floor cover, the gap having a width that is substantially constant in dimension.

8. The modular floor covering system of claim 1, wherein the first edge of the first floor cover and the first edge of the second floor cover define a gap that separates the first edge of the first floor cover and the first edge of the second floor cover, and wherein the connecting element of the first connecting member includes:

a centrally located body disposed running along said gap that separates the first edge of the first floor cover from the first edge of the second floor cover;

a first arm extending from the body in a first direction and a second arm extending from the body in a second direction, wherein the first and second directions are substantially opposite to one another;

a first coupling component protruding upwardly from the first arm into the first through opening of the first floor cover, the first coupling component being located at the first end of the connecting element; and a second coupling component protruding upwardly from the second arm into the first through opening of the second floor cover, the second coupling component being located at the second end of the connecting element.

9. The modular floor covering system of claim 8, wherein the first coupling component is a threaded female element and the first fastener is a threaded male element that is selectively engageable with the threaded female element.

10. The modular floor covering system of claim 8, wherein the first coupling component is a threaded male element and the first fastener is a threaded female element that is selectively engageable with the threaded male element.

11. The modular floor covering system of claim 1, further comprising:

a third floor cover spaced apart from the first floor cover, wherein the third floor cover has a top surface and a bottom surface, said surfaces defining a first edge of said third floor cover, said third floor cover further including a first through opening formed in the third floor cover and located adjacent to the first edge of said third floor cover, and a recess surrounding at least a portion of the first through opening along said top surface of the third floor cover, the surrounding recess and a portion of the first through opening together defining an upper space in the third floor cover, wherein the top and bottom surfaces of the first floor cover define a second edge of the first floor cover, wherein the first floor cover further includes a second through opening formed in the first floor cover and located adjacent to the second edge of said first floor cover, and a second recess surrounding at least a portion of the second through opening along the top surface of the first floor cover, the surrounding second recess and a portion of the second through opening together defining a second upper space in said first floor cover; and a second connecting member selectively connecting the first and third floor covers to one another, wherein the second connecting member includes:

a connecting element extending along the bottom surfaces of the first and third floor covers and having a first end disposed within the second through opening of the first floor cover and a second end disposed within the first through opening of the third floor cover;

a first fastener located within the second upper space of the first floor cover, said first fastener of the second connecting member being selectively attached to the first end of the connecting element of the second connecting member such that the first fastener of the second connecting member engages at least part of the second recess that surrounds the second through opening of the first floor cover, wherein the first fastener of the second connecting member extends entirely within the second upper space of the first floor cover such that the first fastener of the second connecting member does not protrude upwardly above the top surface of the first floor cover; and a second fastener located within the upper space of the third floor cover and selectively attached to the second end of said connecting element of the second connecting member such that the second fastener of the second connecting member engages at least part of the recess that surrounds the first through opening of the third floor cover, wherein the second fastener of the second connecting member extends entirely within the second upper space of the third floor cover such that the second fastener of the second connecting member does not protrude upwardly above the top surface of the third floor cover.

12. The modular floor covering system of claim 11, wherein the first floor cover is arranged between the second and third floor covers.

13. The modular floor covering system of claim 11, wherein the recess of the third floor cover has a first fabric pile and the remainder of the third floor cover has a second fabric pile, wherein the first fabric pile of the third floor cover is shorter in height than the second fabric pile of the third floor cover.

14. The modular floor covering system of claim 11, wherein a fabric material along the recess of the third floor cover has a different texture than a fabric material along the remainder of the third floor cover.

15. The modular floor covering system of claim 1, wherein each of the first and second floor covers has a shape selected from the group consisting of a polygonal shape, a circular shape, an elliptical shape, an oval shape, and an irregular shape.

16. A modular floor covering system comprising:

a first floor cover having a top surface and a bottom surface, said surfaces defining a first edge of said first floor cover, said first floor cover further including a first through opening formed in the first floor cover and located adjacent to the first edge of said first floor cover, and a recess surrounding at least a portion of the first through opening along said top surface of the first floor cover, the surrounding recess and a portion of the first through opening together defining an upper space in said first floor cover;

a second floor cover spaced from the first floor cover, the second floor cover having a top surface and a bottom surface, said surfaces defining a first edge of said second floor cover, said second floor cover further including a first through opening formed in the second floor cover and located adjacent to the first edge of said second floor cover, and a recess surrounding at least a portion of the first through opening of the second floor cover along the top surface thereof, the surrounding recess of the second floor cover and a portion of the first through opening of the second floor cover together defining an upper space in the second floor cover; and a first connecting member selectively connecting the first and second floor covers to one another, the first connecting member including:

a connecting element extending along the bottom surfaces of the first and second floor covers and having a first end disposed within the first through opening of the first floor cover and a second end disposed within the first through opening of the second floor cover;

a first fastener located within the upper space of the first floor cover, said first fastener being selectively attached to the first end of said connecting element such that the first fastener engages at least part of the recess that surrounds the first through opening of the first floor cover, wherein the first fastener extends entirely within the upper space of the first floor cover such that it does not protrude upwardly above the top surface of the first floor cover; and a second fastener located within the upper space of the second floor cover and selectively attached to the second end of said connecting element such that the second fastener engages at least part of the recess that surrounds the first through opening of the second floor cover, wherein the second fastener extends entirely within the upper space of the second floor cover such that it does nor protrude upwardly above the top surface of the second floor cover, wherein the first floor cover is formed of fabric material having a pile construction along the recess thereof that is different than along the remainder of the first floor cover, and wherein the fabric material along the recess of the first floor cover has a different texture than the fabric material along the remainder of the first floor cover.

17. A modular floor covering system comprising:

a first floor cover having a top surface and a bottom surface, said surfaces defining a first edge of said first floor cover, said first floor cover further including a first through opening formed in the first floor cover and located adjacent to the first edge of said first floor cover, and a recess surrounding at least a portion of the first through opening along said top surface of the first floor cover, the surrounding recess and a portion of the first through opening together defining an upper space in said first floor cover;

a second floor cover spaced from the first floor cover, the second floor cover having a top surface and a bottom surface, said surfaces defining a first edge of said second floor cover, said second floor cover further including a first through opening formed in the second floor cover and located adjacent to the first edge of said second floor cover, and a recess surrounding at least a portion of the first through opening of the second floor cover along the top surface thereof, the surrounding recess of the second floor cover and a portion of the first through opening of the second floor cover together defining an upper space in the second floor cover;

a first connecting member selectively connecting the first and second floor covers to one another, the first connecting member including:

a connecting element extending along the bottom surfaces of the first and second floor covers and having a first end disposed within the first through opening of the first floor cover and a second end disposed within the first through opening of the second floor cover;

a first fastener located within the upper space of the first floor cover, said first fastener being selectively attached to the first end of said connecting element such that the first fastener engages at least part of the recess that surrounds the first through opening of the first floor cover, wherein the first fastener extends entirely within the upper space of the first floor cover such that it does not protrude upwardly above the top surface of the first floor cover; and a second fastener located within the upper space of the second floor cover and selectively attached to the second end of said connecting element such that the second fastener engages at least part of the recess that surrounds the first through opening of the second floor cover, wherein the second fastener extends entirely within the upper space of the second floor cover such that it does nor protrude upwardly above the top surface of the second floor cover; and a second connecting member selectively connecting the first and second floor covers to one another, wherein the first floor cover further includes a second through opening formed in the first floor cover and located adjacent to the first edge of said first floor cover, and a second recess surrounding at least a portion of the second through opening along the top surface of the first floor cover, the surrounding second recess and a portion of the second through opening together defining a second upper space in said first floor cover, wherein the second upper space of the first floor cover is spaced apart from the upper space of the first floor cover;

wherein the second floor cover further includes a second through opening formed in the second floor cover and located adjacent to the first edge of the second floor cover, and a second recess surrounding at least a portion of the second through opening of the second floor cover along the top surface thereof, the surrounding second recess of the second floor cover and a portion of the second through opening of the second floor cover together defining a second upper space in the second floor cover, wherein the second upper space of the second floor cover is spaced apart from the upper space of the second floor cover;

wherein the second connecting member includes:

a connecting element extending along the bottom surfaces of the first and second floor covers and having a first end disposed within the second through opening of the first floor cover and a second end disposed within the second through opening of the second floor cover;

a first fastener located within the second upper space of the first floor cover, said first fastener of the second connecting member being selectively attached to the first end of the connecting element of the second connecting member such that the first fastener of the second connecting member engages at least part of the second recess that surrounds the second through opening of the first floor cover, wherein the first fastener of the second connecting member extends entirely within the second upper space of the first floor cover such that the first fastener of the second connecting member does not protrude upwardly above the top surface of the first floor cover; and a second fastener located within the second upper space of the second floor cover and selectively attached to the second end of said connecting element of the second connecting member such that the second fastener of the second connecting member engages at least part of the second recess that surrounds the second through opening of the second floor cover, wherein the second fastener of the second connecting member extends entirely within the second upper space of the second floor cover such that the second fastener of the second connecting member does not protrude upwardly above the top surface of the second floor cover, and wherein the first edge of the first floor cover and the first edge of the second floor cover define a gap that separates the first edge of the first floor cover and the first edge of the second floor cover, the gap having a width that is substantially constant in dimension.

* * * * *